US010669803B2

(12) United States Patent
Bories et al.

(10) Patent No.: US 10,669,803 B2
(45) Date of Patent: Jun. 2, 2020

(54) WELLHEAD ASSEMBLY WITH INTERNAL CASING HANGER PACK-OFF

(71) Applicant: Cameron Technologies Limited, The Hauge, Zuid-Holland (NL)

(72) Inventors: Sébastien Bories, Nissan-lez-enserune (FR); Patrice Couren, Lieuran-les-Béziers (FR); Olivier Frelat, Vias (FR)

(73) Assignee: Cameron Technologies Limited (NL)

( * ) Notice: Subject to any disclaimer, the term of this patent is extended or adjusted under 35 U.S.C. 154(b) by 81 days.

(21) Appl. No.: 15/364,231

(22) Filed: Nov. 29, 2016

(65) Prior Publication Data

US 2017/0152722 A1 Jun. 1, 2017

(30) Foreign Application Priority Data

Dec. 1, 2015 (EP) ..... 15306906

(51) Int. Cl.
*E21B 33/04* (2006.01)
*E21B 33/03* (2006.01)

(52) U.S. Cl.
CPC ..... *E21B 33/04* (2013.01); *E21B 33/03* (2013.01)

(58) Field of Classification Search
CPC ..... E21B 33/04; E21B 33/043
See application file for complete search history.

(56) References Cited

U.S. PATENT DOCUMENTS 3,193,308 A * 7/1965 Todd ..... E21B 33/04 285/123.3
3,378,269 A * 4/1968 Castor ..... E21B 33/038 277/336
4,408,783 A * 10/1983 Gruller ..... E21B 33/043 166/217
4,665,979 A * 5/1987 Boehm, Jr. ..... E21B 33/04 166/208
4,749,047 A * 6/1988 Taylor ..... E21B 33/04 166/182
4,807,705 A * 2/1989 Henderson ..... E21B 33/043 166/208
4,832,125 A * 5/1989 Taylor ..... E21B 33/043 166/182
5,000,266 A * 3/1991 Saunders ..... E21B 33/043 166/136
5,076,356 A * 12/1991 Reimert ..... E21B 33/03 166/115

(Continued)

FOREIGN PATENT DOCUMENTS

GB 2233364 A 1/1991
GB 2352258 A 1/2001

OTHER PUBLICATIONS

PCT International Search Report & Written Opinion for PCT Application No. PCT/US2016/064279 dated Feb. 15, 2017; 12 Pages.

(Continued)

*Primary Examiner* — James G Sayre
(74) *Attorney, Agent, or Firm* — Fletcher Yoder, P.C.

(57) ABSTRACT

Various wellhead assemblies are provided. In one embodiment, the wellhead assemble includes a seal assembly that seals against an inner surface of a wellhead hanger and against an inner surface of a wellhead body. The wellhead hanger can be sized such that the upper portion of the hanger has an outer surface that abuts an inner surface of the wellhead.

20 Claims, 4 Drawing Sheets

(56) References Cited

U.S. PATENT DOCUMENTS

| | | | | |
|---|---|---|---|---|
| 5,868,204 | A | 2/1999 | Pritchett et al. | |
| 6,520,263 | B2 * | 2/2003 | June | E21B 33/04 166/348 |
| 7,032,673 | B2 | 4/2006 | Dezen et al. | |
| 2004/0104024 | A1 * | 6/2004 | Kent | E21B 33/0355 166/85.4 |
| 2004/0231856 | A1 * | 11/2004 | Dallas | E21B 33/04 166/379 |
| 2006/0060348 | A1 | 3/2006 | Allen et al. | |
| 2006/0191680 | A1 * | 8/2006 | Nelson | E21B 33/043 166/208 |
| 2008/0245534 | A1 * | 10/2008 | Purkis | E21B 33/04 166/379 |
| 2013/0341051 | A1 * | 12/2013 | Higgins | E21B 33/04 166/387 |

OTHER PUBLICATIONS

European Examination Report of EP Application No. 15 306 906.7; dated Jun. 25, 2018; 8 pages.
Singapore Written Opinion of SG Application No. 11201804667S; dated Jul. 10, 2019; 8 pages.

* cited by examiner

WELLHEAD ASSEMBLY WITH INTERNAL CASING HANGER PACK-OFF

CROSS REFERENCE TO RELATED APPLICATION

This application claims priority to European Patent Application No. EP 15306906.7, entitled "WELLHEAD ASSEMBLY WITH INTERNAL CASING HANGER PACK-OFF", filed on Dec. 1, 2015, which is herein incorporated by reference in its entirety.

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

To meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource. Further, such systems generally include a wellhead assembly mounted on a well through which the resource is accessed or extracted. These wellhead assemblies may include a wide variety of components, such as various casings, valves, hangers, pumps, fluid conduits, and the like, that facilitate drilling or production operations.

As will be appreciated, various tubular strings can be run into wells through wellhead assemblies. For instance, wells are often lined with casing that generally serves to stabilize the well and to isolate fluids within the wellbore from certain formations penetrated by the well (e.g., to prevent contamination of freshwater reservoirs). Such casing is frequently hung in a well from a hanger in the wellhead assembly and cemented into place within the well. During a cement job, cement can be pumped down a casing string in a well, out the bottom of the casing string, and then up the annular space surrounding the casing string. The cement is then allowed to set in the annular space.

A pack-off or pack-off assembly is used to seal the hanger to the wellhead. Traditionally, hanger pack-off assemblies—which seal the annular space below the hanger from the wellbore above the hanger—reside between the inner surface of the wellhead and the outer surface of the hanger. In certain instances, the hanger may have been landed such that the hanger's central axis is at an angle or "tilted" with respect to the wellhead's and wellbore's central axis. Unfortunately, this increases the effort required to install the hanger pack-off, as the space on one side of the tilted hanger may not be sufficient to accommodate the annular pack-off assembly.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to hanger and pack-off assemblies used in wellheads. In some instances, the pack-off assembly seals against an inner surface of the wellhead body and an inner surface of the hanger. This sealing configuration facilitates sizing of the upper portion of the hanger's (e.g., casing hanger's, tubing hanger's) outer surface diameter to closely match the head's (e.g., casing head's, tubing head's) inner surface diameter. The close tolerances between the two surfaces guides the hanger during installation, reducing the likelihood the hanger will be tilted when landed. It further, in certain embodiments, can reduce the trapping of debris between the hanger and wellhead body, improving the wellhead assembly's resistance to wear.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
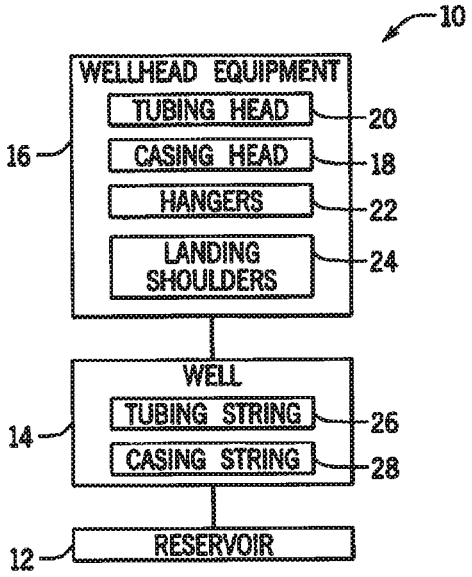
FIG. 1 generally depicts various components, including one or more tubular strings and associated hangers and wellhead bodies, that can be installed at a well, in accordance with one embodiment of the present disclosure.

Turning now to the present figures, a system 10 is illustrated in FIG. 1 in accordance with one embodiment. Notably, the system 10 is a production system that facilitates extraction of a resource, such as oil, from a reservoir 12 through a well 14. Wellhead equipment 16 is installed on the well 14. As depicted, the wellhead equipment 16 includes at least one wellhead body, such as casing head 18 and tubing head 20, as well as wellhead hangers 22 disposed in the bodies. But the components of the wellhead equipment 16 can differ between applications, and could include a variety of casing heads, tubing heads, spools, hangers, sealing assemblies, stuffing boxes, pumping tees, and pressure gauges, to name only a few possibilities.

The wellhead hangers 22 can be positioned on landing shoulders 24 within hollow wellhead bodies (e.g., within the tubing and casing heads). These landing shoulders 24 can be integral parts of tubing and casing heads or can be provided by other components, such as sealing assemblies or landing rings disposed in the tubing and casing heads. Each of the hangers 22 can be connected to a tubular string, such as a tubing string 26 or a casing string 28, suspended within the well 14. The well 14 can include a single casing string 28 or include multiple casing strings 28 of different diameters. Any suitable devices or machines may be used to run tubular strings into wells through wellheads and install hangers attached to the tubular strings in the wellheads.

Figure 2:
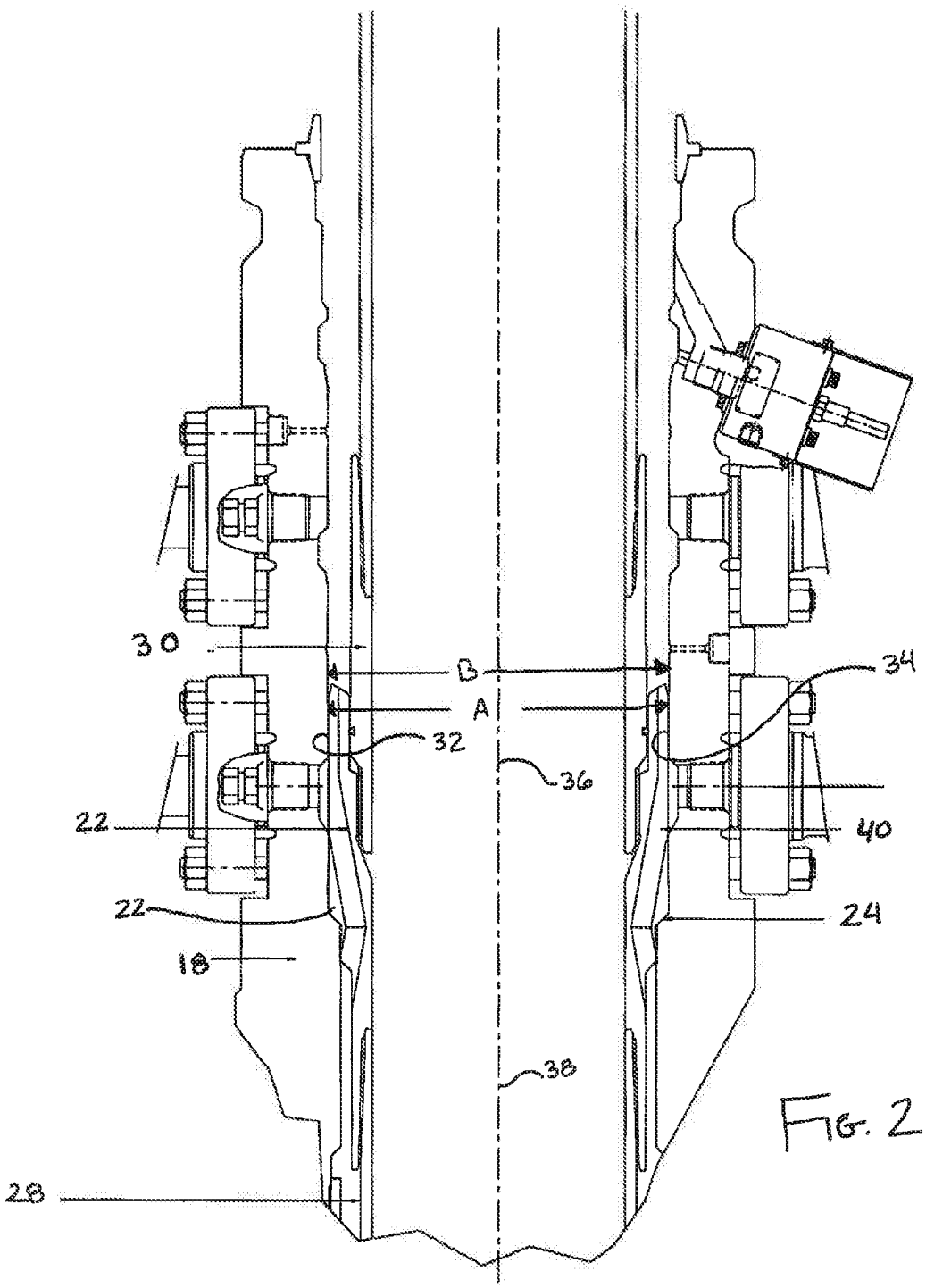
FIG. 2 is a section view of hanger installed in a wellhead and coupled to a running tool, in accordance with one embodiment of the present disclosure.

For example, a top drive coupled to a hanger running tool 30 can be used to land the casing hanger 22 in the casing head 18, as shown in FIG. 2. The illustrated casing hanger 22 has an outer diameter "A" that is closely matched to the inner diameter "B" of the casing head 18, and the profile of the upper portion of the hanger's outer surface 32 is complementary to the profile of casing head's inner surface 34. Thus, as the casing head 18 is lowered, the interaction or abutment of these two surfaces 32, 34 guides the hanger 22, helping to ensure the hanger's longitudinal axis 36 remains coaxial with the head's longitudinal axis 38. That is, the hanger's longitudinal axis 36 is not "tilted" with respect to head's 38 and, in turn, the wellbore's. By providing mechanical guidance, the hanger can be installed more efficiently and with less susceptibility to human error.

The hanger 22 is lowered into the head 18 until a sloped surface on the hanger engages a load shoulder 24 that's on the head and that supports the hanger 22 and the casing string 28 threaded to the hanger 22. The load shoulder 24 prevents further downward movement of the hanger 22, while the complementary profile of the hanger and head prevents lateral movement of the hanger, particularly towards the top of the hanger 22. This, in turn, prevents tilting of the hanger when exposed to lateral forces or moments. The close fit and complementary nature of these two surfaces also retards the ingress of debris between these two components, even before installation of pack-off (as is discussed below). Indeed, this arrangement, in comparison to traditional designs, may benefit by not requiring a washing step to clean the casing hanger before installation of the pack-off (again, as discussed below).

Casing strings 28 are often cemented in place within the well. In some instances, cement is pumped down a casing string 28 and into an annular space around the casing string 28. A plug can then be pumped down the casing string 28 with a displacement fluid (e.g., drilling mud) to generally push additional cement in the casing string out the bottom and into the annular space. As the cement fills the annular space, it displaces drilling mud present in the annular space before cementing began. This causes the displaced drilling mud to flow up the well to the wellhead. The illustrated hanger 22 include one or more passages 40, often called flutes or flow-by holes, that allow for drilling mud and/or cement to flow around the casing hanger.

Figure 3:
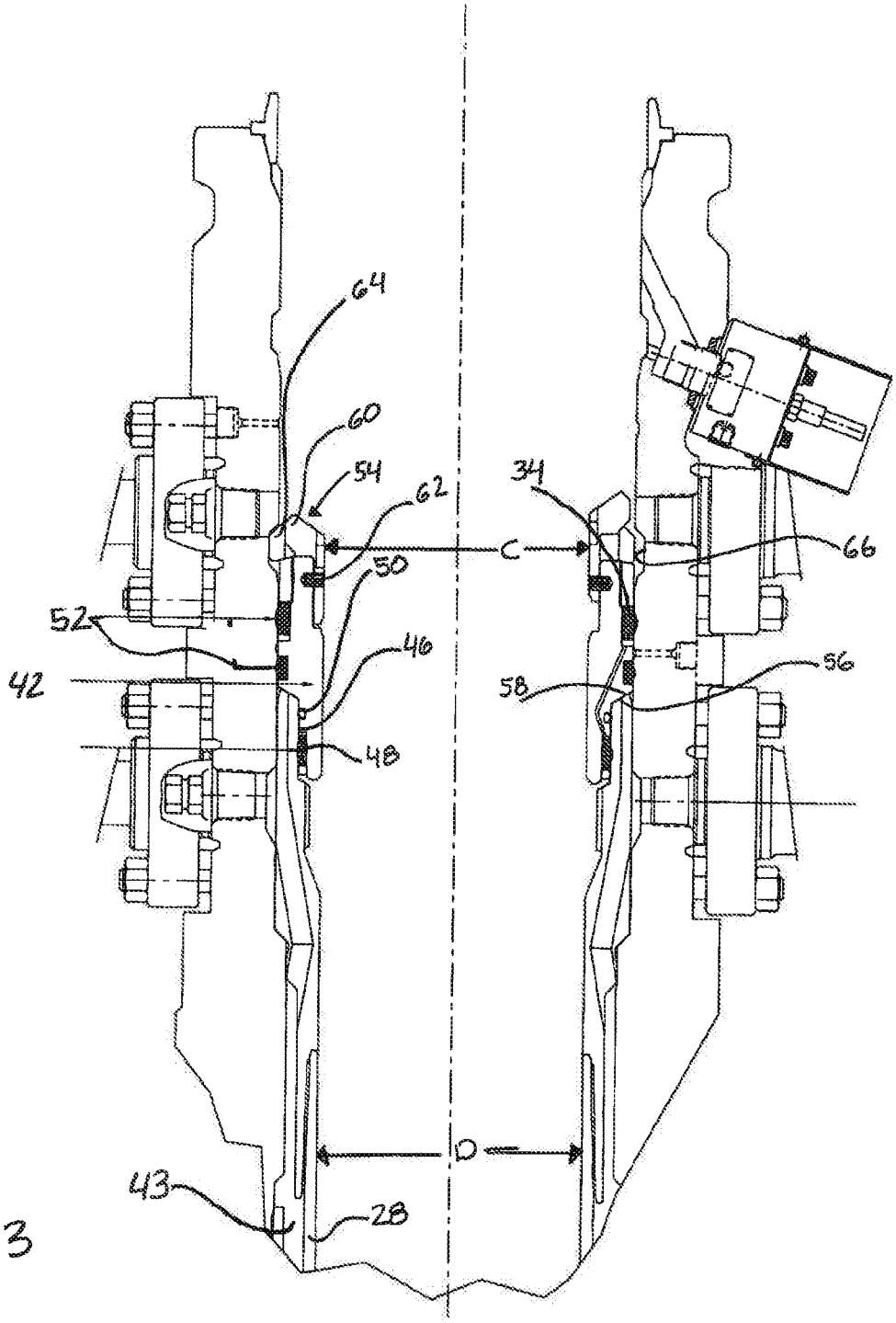
FIG. 3 is a section view of the hanger of FIG. 2 decoupled from the running tool and with a hanger pack-off, in accordance with one embodiment of the present disclosure.

FIG. 3 illustrates a landed casing hanger 22 decoupled from the hanger running tool 30 (FIG. 2). A pack-off assembly 42 located at the upper portion of the hanger 22 seals the now-cemented annulus 43 from the portion of the wellbore above the hanger 22. Unlike traditional pack-off assemblies, the illustrated pack-off 42 seals against a radially inner surface 46 of the hanger 22. For example, the pack-off 42 has an extended lower portion that carries a primary lower elastomeric seal 48 and a back-up seal 50, which may be an S-seal or elastomeric o-ring seal. The upper portion of the pack-off assembly 42 carries two upper elastomeric seals 52 that seal against the inner surface of the head 34. Once installed, the pack-off assembly's seals 48, 50, and 52 cooperate to prevent the egress of wellbore pressure from the cemented annulus 43 to the portion of the wellbore located above the casing hanger 22. Moreover, the fact that all of these seals are located on the radially outboard or external side of the pack-off assembly improves wear resistance, as compared to traditional pack-off assemblies where seals are located on both sides of the annular pack-off assembly.

The pack-off's inner diameter "C" may be sized to the equal to or greater than the casing string's inner diameter "D." This provides for "full-bore access" to the casing string, and ensures the pack-off does not restrict the passage of down-hole tools into the wellbore and casing string 28, for instance.

A locking mechanism 54 secures the pack-off assembly 42 to the casing head 18, causing, in certain embodiments, the pack-off assembly to block upward movement of the hanger 22 and to squeeze (energize) some of the pack-off's seals. For example, a pack-off running tool, which is not shown but the likes of which are well understood, may be used to lower the pack-off assembly 42 onto the hanger. Complementary surfaces 56 and 58 on the hanger 22 and pack-off assembly 42 engage to land the pack-off at the desired location in the head, similar in operation to the landing shoulder 24 controlling the location of the casing hanger 22 within the casing head 18.

Once landed, the pack-off running tool (not shown) can be used to actuate the locking mechanism 54. The right side of FIG. 3 depicts the locking mechanism 54 in an unlocked configuration. The pack-off running tool may rotate a cam 60 such that a pin 62 progress through a Z-shaped slot, causing the cam 60 to move downward and into the position shown on the left side of FIG. 3. Downward movement of the cam 60 pushes locking member 64 radially outward and into engagement with a complementary recess 66 in the casing head 18.

The secured pack-off assembly provides sealing benefits to wellbore pressure potentially in the cemented annulus 43. For example, the close fit between the pack-off assembly's seals and respective seal surfaces limits gaps through which the elastomeric seals might extrude. In turn, because extrusion is limited, when wellbore pressures apply axially on the seals, the seals radially expand, improving the sealing between the casing hanger and casing head.

Figure 4:
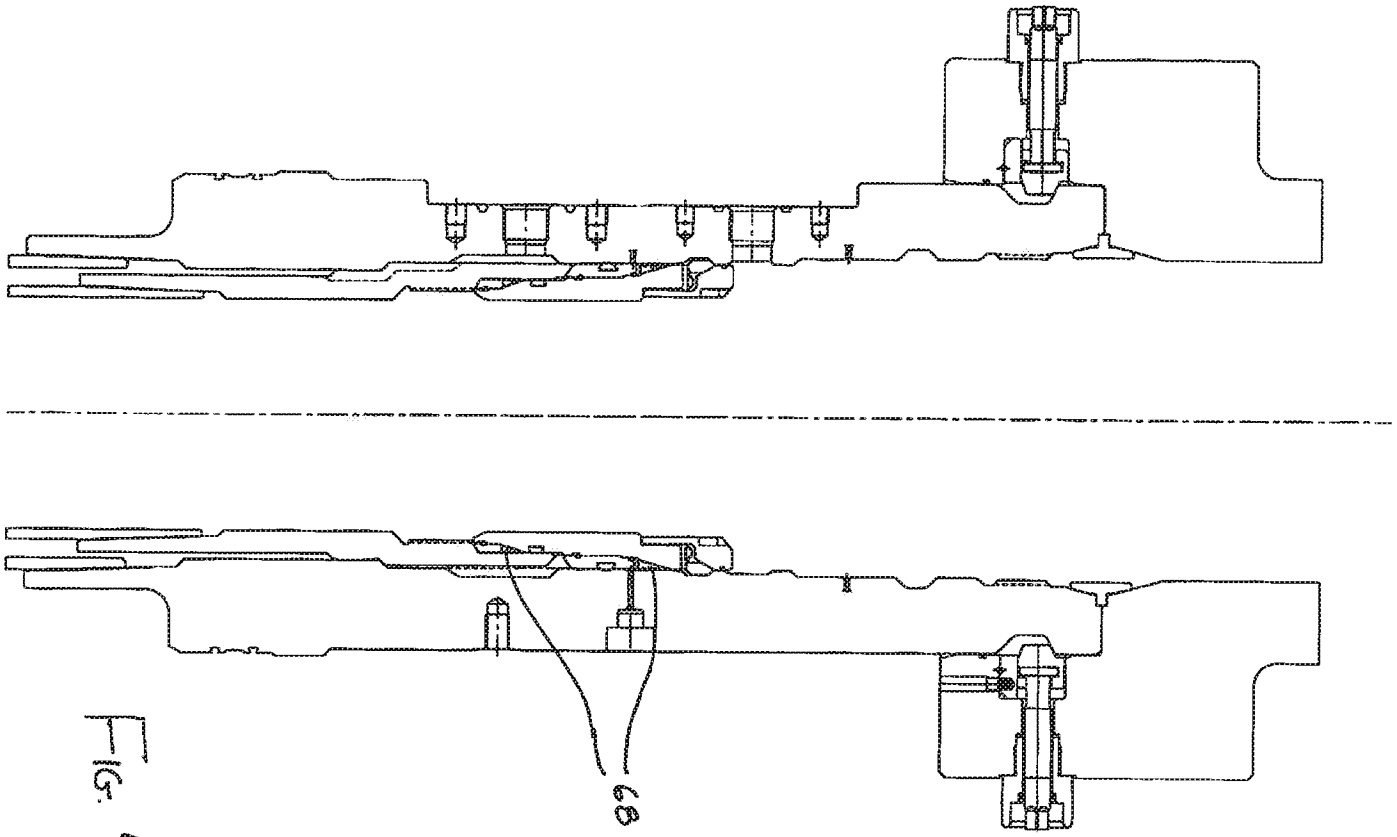
FIG. 4 is a section view of a hanger and hanger pack-off assembly with metal sealing features, in accordance with one embodiment of the present disclosure.

FIG. 4 illustrates another embodiment of a pack-off assembly. 42. Here, the pack-off assembly's seals are metal seals 68, such as CAHN seals.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A wellhead assembly, comprising:

a wellhead body;

a wellhead hanger disposed in the wellhead body; and a sealing assembly, comprising:

a seal body;

a first seal coupled to the seal body and sealing against an inner surface of the hanger;

a second seal coupled to the seal body and sealing against an inner surface of the wellhead body;

a radial lock coupled to the seal body, wherein the sealing assembly is disposed axially between the wellhead hanger and the radial lock, such that the second seal is disposed axially between a first top surface of the wellhead hanger and a bottom surface of the radial lock; and an actuator configured to drive the radial lock in a radial direction between an unlocked position and a locked position, wherein the wellhead assembly excludes an outer seal configured to seal directly between an outer surface of the wellhead hanger and the inner surface of the wellhead body.

2. The system of claim 1, wherein the actuator comprises a cam configured to rotate to drive the radial lock in the radial direction.

3. The system of claim 1, wherein the first and second seals are removably coupled to the seal body, the first and second seals are axially offset from one another, and at least one of the first or second seals is an elastomer.

4. The system of claim 1, wherein the seal body abuts the first top surface of the wellhead hanger, and the radial lock abuts a second top surface of the seal body.

5. The system of claim 1, wherein the wellhead hanger comprises a wall disposed about a central bore, and the wellhead hanger comprises one or more cement passages in the wall.

6. The system of claim 1, wherein the wellhead hanger comprises an upper portion disposed above a landing shoulder in the wellhead body, wherein the upper portion of the wellhead hanger has an outer profile that is closely matched with and directly abuts an inner profile of an inner wellhead surface of the wellhead body above the landing shoulder to retard an ingress of debris between the wellhead hanger and the wellhead body.

7. A wellhead assembly, comprising:

a wellhead body having a landing shoulder;

a wellhead hanger supported in the wellhead body by the landing shoulder, wherein the wellhead hanger directly abuts the landing shoulder, the wellhead hanger comprises an upper portion disposed above the landing shoulder, and the upper portion of the wellhead hanger has an outer profile that is closely matched with and directly abuts an inner profile of an inner wellhead surface of the wellhead body above the landing shoulder to retard an ingress of debris between the wellhead hanger and the wellhead body, the outer profile extends along an axial length of the upper portion of the wellhead hanger, and the wellhead hanger excludes an outer seal configured to seal directly between the wellhead hanger and the inner wellhead surface.

8. The system of claim 7, wherein the landing shoulder is integral to the wellhead body.

9. The system of claim 7, wherein the wellhead hanger comprises a first outer surface that abuts an inner landing surface of the landing shoulder at a first interface, and the wellhead hanger comprises a second outer surface having the outer profile that abuts the inner profile of the inner wellhead surface of the wellhead body at a second interface.

10. The system of claim 9, wherein the second interface is configured to resist tilting of the wellhead hanger relative to an axis of the wellhead assembly.

11. The system of claim 9, wherein the wellhead assembly is configured to bear a load in an axial direction relative to an axis of the wellhead assembly at the first interface but not the second interface.

12. The system of claim 7, wherein each of the outer profile of the wellhead hanger and the inner profile of the inner wellhead surface extends in an axial direction coaxial with the axis of the wellhead assembly along the axial length of the upper portion of the wellhead hanger.

13. The system of claim 7, wherein the wellhead hanger comprises a wall disposed about a central bore, and the wellhead hanger comprises one or more cement passages in the wall.

14. The system of claim 7, comprising a sealing assembly, comprising:

a seal body;

a first seal removably coupled to the seal body and sealing against a first inner surface of the wellhead hanger;

a second seal removably coupled to the seal body and sealing against a second inner surface of the wellhead body, wherein the first and second seals are axially offset from one another;

a radial lock coupled to the seal body, wherein the sealing assembly is disposed axially between the wellhead hanger and the radial lock, such that the second seal is disposed axially between a first top surface of the wellhead hanger and a bottom surface of the radial lock; and an actuator configured to drive the radial lock in a radial direction between an unlocked position and a locked position.

15. The system of claim 14, wherein the actuator comprises a cam configured to rotate to drive the radial lock in the radial direction.

16. A system, comprising:

a sealing assembly, comprising:

a seal body;

a first seal coupled to the seal body, wherein the first seal is configured to seal against a first inner surface of a hanger;

a second seal coupled to the seal body, wherein the second seal is configured to seal against a second inner surface of a wellhead body;

a radial lock coupled to the seal body, wherein the sealing assembly is configured to be disposed axially between the hanger and the radial lock, such that the second seal is disposed axially between a first top surface of the hanger and a bottom surface of the radial lock; and an actuator configured to drive the radial lock in a radial direction between an unlocked position and a locked position, wherein the system excludes an outer seal configured to seal directly between an outer surface of the hanger and the second inner surface of the wellhead body.

17. The system of claim 16, wherein the hanger comprises a wall disposed about a central bore, and the hanger comprises one or more fluid passages in the wall.

18. The system of claim 16, wherein the actuator comprises a cam configured to rotate to drive the radial lock in the radial direction.

19. The system of claim 16, wherein the actuator comprises a pin disposed in a slot having at least one angled slot portion, and the pin is configured to move along the slot to bias the radial lock in the radial direction.

20. The system of claim 19, wherein the slot comprises a Z-shaped slot having the at least one angled slot portion.

* * * * *